United States Patent [19]

Barba

[11] Patent Number: 4,891,994

[45] Date of Patent: Jan. 9, 1990

[54] LINEAR ELECTROMECHANICAL ACTUATOR

[75] Inventor: Valentin G. Barba, Princeton Junction, N.J.

[73] Assignee: Plessey Incorporated, White Plains, N.Y.

[21] Appl. No.: 309,109

[22] Filed: Feb. 13, 1989

[51] Int. Cl.[4] ..... G05G 17/00

[52] U.S. Cl. ..... 74/2; 74/625; 251/68; 335/173; 335/253

[58] Field of Search ..... 74/2, 625; 89/1.55, 89/1.56; 124/31, 32; 251/68; 292/332, 333; 335/173, 253

[56] References Cited

U.S. PATENT DOCUMENTS

| | | | |
|---|---|---|---|
| 1,391,469 | 9/1921 | Getchell | 335/173 |
| 1,510,445 | 9/1924 | Henry | 74/2 |
| 2,304,844 | 12/1942 | Parker et al. | 251/68 |
| 2,535,095 | 12/1950 | Schwartz et al. | 74/2 |
| 2,776,570 | 1/1957 | Nelson et al. | 74/2 |
| 2,778,226 | 1/1957 | Lardin | 74/2 |
| 3,181,908 | 5/1965 | Clark | 294/83 |
| 3,364,752 | 1/1968 | Hjermstad et al. | 74/2 |
| 3,605,050 | 9/1971 | Goldman | 335/173 X |
| 3,672,233 | 6/1972 | Hjermstad et al. | 74/2 |
| 3,730,005 | 5/1973 | Hjermstad et al. | 74/2 |
| 3,877,343 | 4/1975 | Newell et al. | 89/1.5 R |
| 4,136,569 | 1/1979 | Hollweck | 74/2 |
| 4,557,177 | 12/1985 | Cheney | 89/1.51 |
| 4,563,908 | 1/1986 | Shube | 74/2 |

FOREIGN PATENT DOCUMENTS

| | | | |
|---|---|---|---|
| 2419732 | 11/1975 | Fed. Rep. of Germany | 335/253 |
| 567003 | 8/1977 | U.S.S.R. | 251/68 |

*Primary Examiner*—Allan D. Herrmann

*Attorney, Agent, or Firm*—Robert R. Jackson; John E. Nathan

[57] ABSTRACT

A linear electromechanical actuator has a spring-loaded plunger disposed in a housing. When a solenoid in the housing is energized, the armature of the solenoid moves linearly and, after some initial "lost" motion, engages and releases the latch mechanism holding the plunger in the housing. The spring associated with the plunger is then free to extend the plunger from the housing. The actuator can be designed so that it is highly immune from unintended actuation due to acceleration of the actuator. The condition of the actuator (e.g., fully cocked or released) can be monitored by switches disposed in the actuator. The actuator can also be constructed to allow manual release as an alternative to release by energization of the solenoid.

18 Claims, 5 Drawing Sheets

LINEAR ELECTROMECHANICAL ACTUATOR

BACKGROUND OF THE INVENTION

This invention relates to electromechanical actuators, and more particularly to linear electromechanical actuators which are highly resistant to unintended actuation due to mechanical shock, vibration, or sudden acceleration.

Linear electromechanical actuators are widely used for such purposes as providing a mechanical input to cause a load-holder to release its load. For example, Schwartz et al. U.S. Pat. No. 2,535,095 shows a bomb shackle release intended for use on aircraft and including a linear electromechanical actuator 15 which responds to an applied electrical signal by extending head 26 from housing 16, 17. Extension of head 26 in this manner moves release lever 11 and causes shackle S to drop its load (e.g., a bomb, an extra fuel tank, a container of supplies, or any other "store"). It is extremely important that such actuators not fire except when intended. In particular, it is extremely important for such actuators to be highly resistant to inadvertent actuation due to mechanical shock, vibration, or sudden acceleration.

Many actuators of the type generally shown by Schwartz et al. have been devised. Most of these devices have resistance to unintended actuation as an objective. However, none of these devices has fully attained that objective, and many have become extremely complicated. Such complication increases the cost and decreases the reliability of these devices.

In view of the foregoing, it is an object of this invention to provide improved and simplified linear electromechanical actuators of the type described above.

It is a more particular object of this invention to provide linear electromechanical actuators which are relatively simple in construction but which are both highly reliable and highly resistant to inadvertent actuation.

SUMMARY OF THE INVENTION

These and other objects of the invention are accomplished in accordance with the principles of the invention by providing linear electromechanical actuators having a spring-loaded actuator member disposed in a housing. Prior to actuation, the actuator member is retained in the housing by latch means which can be released by moving a spring-loaded blocking member longitudinally from a blocking position to a release position. A solenoid including a longitudinally movable, spring-loaded armature is also disposed in the housing and coupled to the blocking member so that an initial portion of the motion of the armature in response to energization of the solenoid has no effect on the blocking member, but so that subsequent motion of the armature causes the blocking member to move from the blocking position to the release position. This releases the latch means and allows the actuator member to extend from the housing.

Further features of the invention, its nature and various advantages will be more apparent from the accompanying drawings and the following detailed description of the preferred embodiments.

BRIEF DESCRIPTION OF THE DRAWINGS

FIG. 1 shows the actuator in the cocked condition.

DETAILED OF THE PREFERRED EMBODIMENTS

Figure 1:
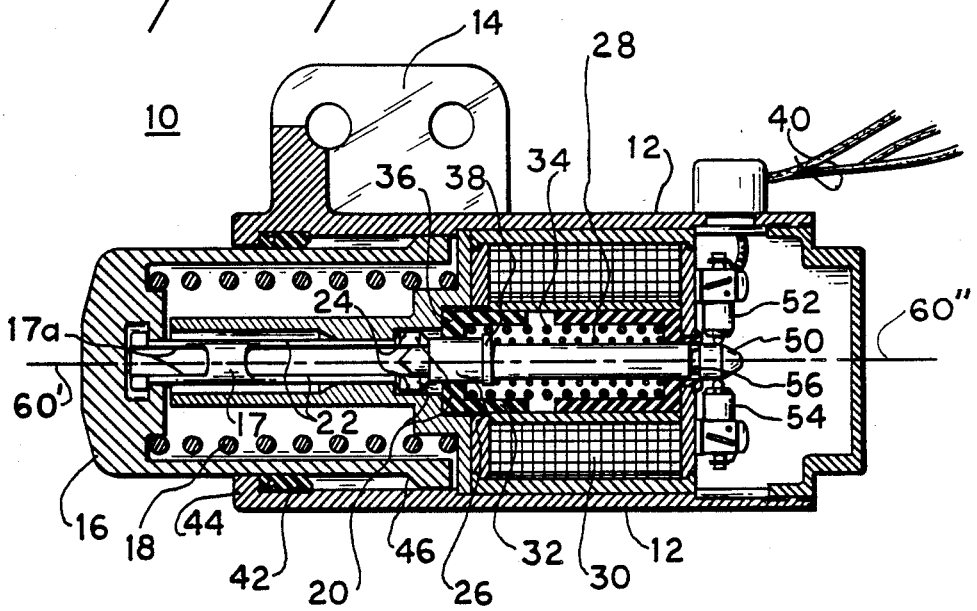
FIG. 1 is a longitudinal sectional view of a linear electromechanical actuator constructed in accordance with this invention.

As shown in FIG. 1, a typical linear electromechanical actuator 10 constructed in accordance with the principles of this invention includes a substantially cylindrical housing 12 having a bracket 14 by means of which the actuator can be mounted to any suitable support structure (not shown). A substantially cylindrical (preferably completely cylindrical) actuator member or plunger 16 is mounted for longitudinal reciprocation relative to housing 12 along a first longitudinal axis 60'. Plunger 16 is secured to the left-hand end of collet 17 by virtue of the shoulders on tines 17*a* engaging the radially inwardly projecting shoulder on plunger 16. The tined structure 17*a* is used to allow collet 17 to be snapped into plunger 16 during assembly of the apparatus.

As has been mentioned, FIG. 1 shows actuator 10 in the cocked condition (i.e., prior to firing or actuation). In this condition, plunger 16 is pushed into housing 12 (to the right as viewed in FIG. 1) againt the outward (leftward) bias of prestressed compression coil spring 18. Plunger 16 is held in that position by the enlarged ends 20 of tines 22 engaging shoulder 24 on an interior structure connected to housing 12. (Although only two tines 22 are visible in the drawings, it will be understood that more than two circumferentially spaced tines may be provided if desired.) The enlarged end 20 of each tine 22 has a conical shoulder which engages radial shoulder 24. The typical cone half angle is (but is not restricted to) 75° from the longitudinal axis of the actuator (or 15° from a radial plane). Because of this angle, axial forces applied between the enlarged ends 20 and shoulder 24 develop a radial component which tends to deflect tines 22 and enlarged ends 20 radially inward. When the actuator is cocked, tines 22 cannot move inward because pin 26 is partly interposed between the tines. Pin 26 is resiliently urged into that blocking position be prestressed compression coil spring 28. Elements 20, 22, 24, 26, and 28 therefore cooperate with one another to provide a releasable latch for holding plunger 16 in (to the right as viewed in FIG. 1) against the considerable outward (leftward) force of spring 18.

To the right of plunger 16 as viewed in FIG. 1 housing 12 also contains a cylindrical solenoid coil 30. An axially movable, substantially cylindrical (preferably completely cylindrical) armature member 32 is disposed in solenoid coil 30. Armature 32 is resiliently urged to the left as viewed in FIG. 1 by prestressed compression coil spring 34. Armature 32 is concentric with pin 26 and has a radially inwardly projecting shoulder 36 spaced to the left of a radially outwardly projecting shoulder 38 on pin 26 as viewed in FIG. 1. Note that in the cocked position, the switch actuator portion 50 of pin 26 engages the operators of both of electrical switches 52 and 54.

Figure 2:
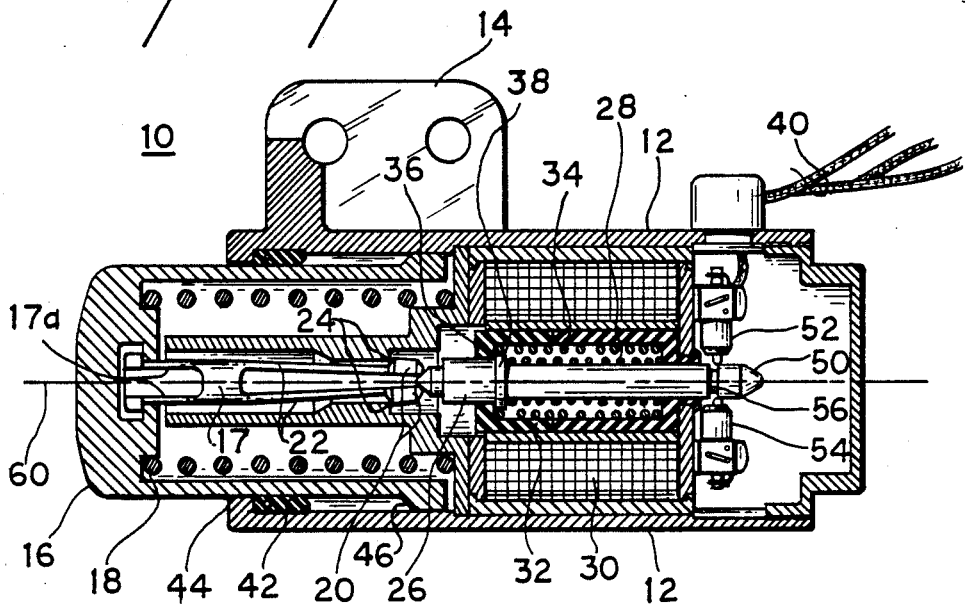
FIGS. 2–4 views similar to FIG. 1 showing successive stages in the firing cycle of the actuator of FIG. 1.

When solenoid 30 is energized by an electrical current applied via leads 40, armature 32 is pulled longitudinally into coil 30 as shown in FIG. 2. During an initial portion of this rightward motion of armature 32, there is no effect on pin 26 because of the initial spacing between shoulders 36 and 38. Once the initial gap between shoulders 36 and 38 has been closed, however, shoulder 36 engages shoulder 38 and moves pin 26 to the right with armature 32. Note that the kinetic energy of armature 32 helps ensure that and frictional or other resistance to motion of pin 26 is overcome.

Figure 3:
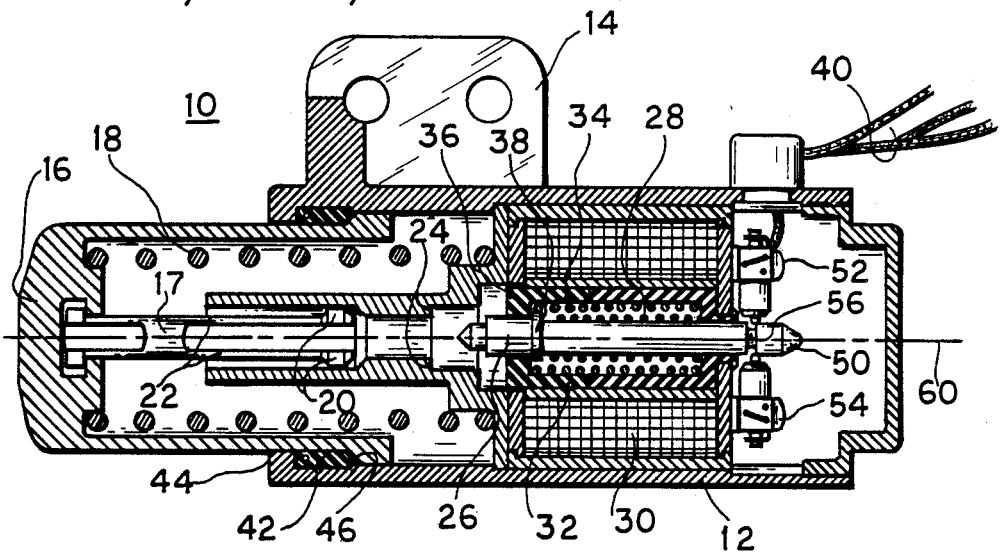

The above-described rightward motion of pin 26 removes the pin from between tines 22. This allows tines 22 to be deflected inwardly by the axial force of spring 18 acting on plunger 16 and collet 17, thereby releasing the latching engagement between elements 20 and 24. Spring 18 is therefore now free to push plunger 16 to the left as viewed in FIG. 3. Plunger 16 is brought to a stop by shock-absorbing elements 42 acting between shoulders 44 and 46.

Figure 4:
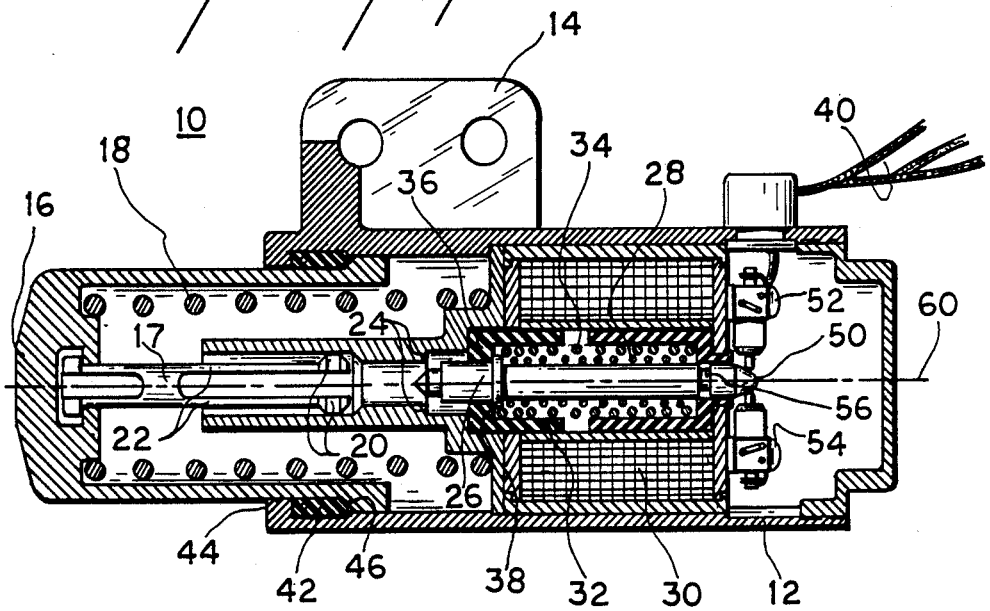

When the current applied to solenoid 30 is discontinued, spring 34 pushes armature 32 back to its initial position. As shown in FIG. 4, this allows spring 28 to push pin 26 back to a position even farther to the left than its initial position because tines 22 are no longer present in their initial positions to stop the leftward motion of pin 26. Accordingly, the switch actuator portion 50 of pin 26 now releases the operators of switches 52 and 54 for the first time, thereby allowing the contacts of those switches to transfer. FIG. 4 therefore shows the full final condition of actuator 10 after actuation.

Figure 5:
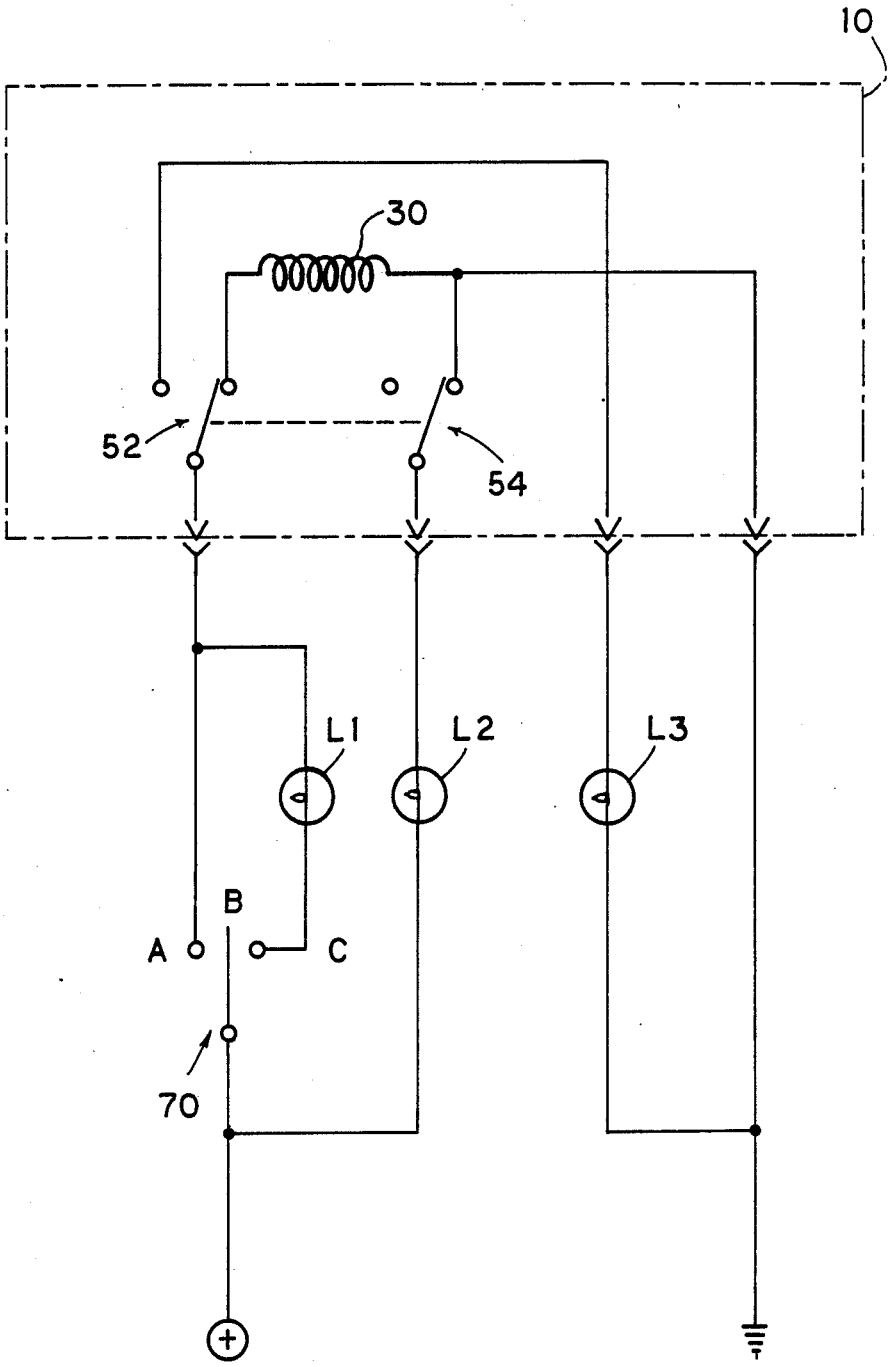
FIG. 5 is a schematic diagram of illustrative control circuitry for the actuator of FIG. 1.

Although actuators of the type shown herein can be used in a wide variety of control circuit configurations, for purposes of illustration FIG. 5 shows one possible configuration. In FIG. 5, actuator 10 is shown in the cocked position, with switches 52 and 54 making the connections shown. In the associated control circuitry, switch 70 is initially in the neutral (B) position. Lamp L2 is illuminated to confirm that the actuator is cocked. The operator can check the firing circuit by moving switch 70 to the C position. This causes low current lamp L1 to light, thereby confirming that solenoid coil 30 is intact, and that the actuator is cocked and has not been fired.

To fire the actuator, the operator moves switch 70 to the A position. This energizes solenoid coil 30 and causes the actuator to fire as described above. After switch 70 is moved back to the B position, switches 52 and 54 transfer, and lamp L2 goes out. If switch 70 is subsequently moved to the C position, lamp L1 will not glow brightly, but lamps L1 and L3 will both glow dimly. If switch 70 is moved to firing position A, the only effect will be to cause lamp L3 to glow brightly.

Figure 6:
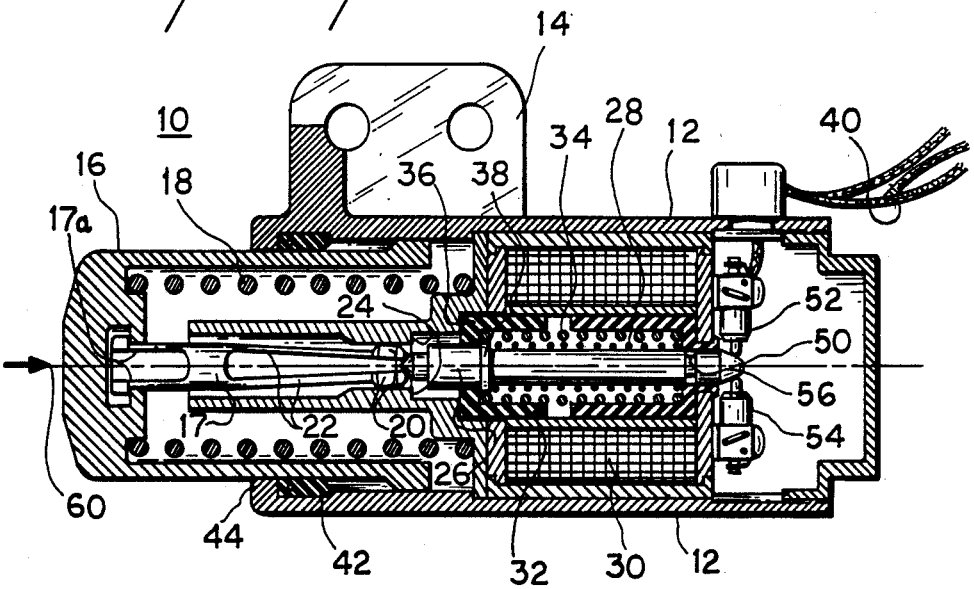
FIGS. 6 and 7 are views similar to FIG. 1 showing successive stages in the recocking cycle of the actuator of FIG. 1.
Figure 7:
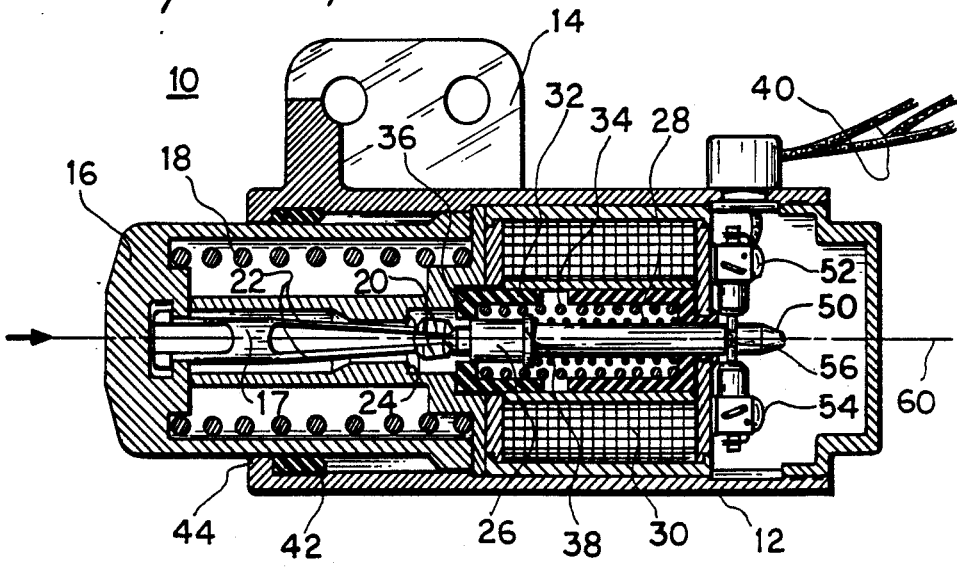

Returning now to the mechanical aspects of the invention, actuator 10 can be recocked (i.e., restored to the cocked condition shown in FIG. 1) at any time by pushing plunger 16 back in. FIGS. 6 and 7 show successive stages in the cocking operation. As plunger 16 begins to be pushed back in, the right-hand ends of tines 22 contact the left-hand end of pin 26 and begin to push the pin to the right as shown in FIG. 6. The initial motion of pin 26 causes the operators of switches 52 and 54 to ride up to the full diameter of pin 26, thereby transferring switches 52 and 54 to the cocked position. Just as the enlarged ends 20 of tines 22 pass shoulders 24 (see FIG. 7), the operators of switches 52 and 54 drop into annular groove 56 near the right-hand end of pin 26, thereby causing these switches to transfer back to the uncocked position. If the cocking operation is successfully completed, tines 22 spring open after the enlarged ends 20 pass shoulder 24, and the left-hand end of pin 26 enters the space between tines 22, thereby restoring the actuator to the fully cocked condition shown in FIG. 1. This causes switches 52 and 54 to transfer again. On the other hand, if pin 26 does not enter the space between tines 22 so that the actuator is not fully cocked, the operators of switches 52 and 54 remain in groove 56. This enables switches 52 and 54 to produce an output indication that the actuator is not fully cocked. For example, if the actuator is used with the control circuit of FIG. 5, then with the operators of switches 52 and 54 in groove 56, the contacts of switches 52 and 54 are thrown to the left. This prevents illumination of lamp L2.

Actuator 10 cannot be falsely actuated by accelerations of any likely magnitude perpendicular to or rotationally about its longitudinal axis 60. A particularly advantageous feature of the design in this regard is the fact that all of the latching and release control elements (i.e., elements 17, 24, 26, and 32) are preferably completely symmetrical about axis 60. The actuator can also be rendered immune to accelerations up to a desired limit parallel to axis 60 by appropriate choice of the mass of elements 26 and 32 and the spring forces of elements 28 and 34. For example, to prevent armature 32 from moving in response to an acceleration from right to left up to a predetermined acceleration A1, the mass M1 of armature 32 and the force F1 exerted by spring 34 are selected so that F1 is greater than M1 times A1. Unless armature 32 moves, it cannot dislodge pin 26 from the latching or blocking position between tines 22. Similarly, to prevent pin 26 from moving in response to an acceleration from right to left up to a predetermined acceleration A2, the mass M2 of pin 26 and the force F2 exerted by spring 28 are selected so that F2 is greater than M2 times A2. Once again, the actuator cannot fire unless pin 26 moves from the latching or blocking position between tines 22.

Figure 8:
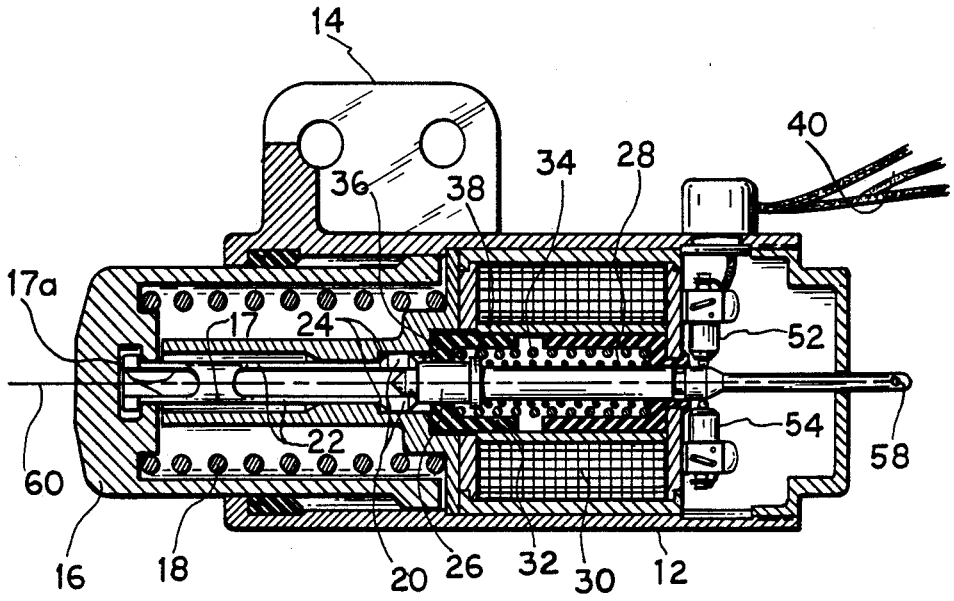
FIG. 8 is a view similar to FIG. 1 showing an alternative embodiment of the invention.

If desired, actuator 10 can be made manually releasable by including means for allowing pin 26 to be manually pulled to the right as viewed in FIG. 1. For example, a cable or lanyard could be attached to the right-hand end of pin 26 and passed through a hole in the right-hand end of housing 12. Alternatively, pin 26 could be extended through a hole in the right-hand end of housing 12 as shown in FIG. 8 to provide a more accessible attachment point 58 for a cable or lanyard (not shown).

I claim:

1. A linear elctromechanical actuator comprising:

a housing a first longitudinal axis;

a solenoid coil disposed in said housing and having a second longitudinal axis;

an armature electromagnetically coupled to said solenoid coil and mounted for longitudinal motion in a first direction along said second longitudinal axis in response to energization of said solenoid coil;

first means for resiliently urging said armature to move in a second direction along said second longitudinal axis, said second direction being opposite to said first direction, said solenoid coil being strong enough when energized to overcome the effect of said first means on said armature and cause said armature to move in said first direction;

an actuator member mounted for longitudinal reciprocation along said first longitudinal axis;

second means for resiliently urging said actuator member to move from a first position to a second position along said first longitudinal axis;

means for releasably retaining said actuator member at said first position;

means for operatively connecting said armature to said means for releasably retaining so that after a predetermined amount of motion of said armature in said first direction, said armature causes said means for releasably retaining to release said actuator member, thereby allowing said second means for resiliently urging to move said actuator member from said first position to said second position; and means responsive to said means for releasably retaining said actuator member at said first position for producing an output indication if and only if said means for releasably retaining is fully operational to retain said actuator member at said first position.

2. The actuator defined in claim 1 wherein said actuator is designed to resist release of said actuator member despite acceleration of said actuator in said second direction up to a first predetermined acceleration, wherein said armature has a first predetermined mass, wherein said first means for resiliently urging exerts a first predetermined force on said armature parallel to said second longitudinal axis, and wherein said first predetermined mass and said first predetermined force are selected such that said first predetermined force is greater than the product of said first predetermined acceleration and said first predetermined mass.

3. The actuator defined in claim 1 wherein said means for releasably retaining comprises:

first latch means secured to said housing;

second latch means secured to said actuator member; and means for releasably maintaining said first latch means in engagement with said second latch means in order to retain said actuator member at said first position when said first latch means is in engagement with said second latch means.

4. The actuator defined in claim 3 wherein said first and second latch means move relative to one another transverse to said first longitudinal axis in order to disengage from one another, and wherein said means for releasably maintaining comprises:

a blocking member mounted for longitudinal reciprocation along said first longitudinal axis between (1) a blocking position in which said blocking member prevents relative motion of said first and second latch means transverse to said first longitudinal axis and thereby maintains said first and second latch means in engagement with one another, and (2) a release position in which said blocking member allows relative motion of said first and second latch means transverse to said first longitudinal axis and thereby allows said first and second latch means to disengage from one another; and third means for resiliently urging said blocking member to remain in said blocking position.

5. The actuator defined in claim 4 wherein said actuator is designed to resist release of said actuator member despite acceleration of said actuator parallel to said first longitudinal axis in the direction from said release position to said blocking position up to a second predetermined acceleration, wherein said blocking member has a second predetermined mass, wherein said third means for resiliently urging exerts a second predetermined force on said blocking member parallel to said first longitudinal axis, and wherein said second predetermined mass and said second predetermined force are selected such that said second predetermined force is greater than the product of said second predetermined acceleration and said second predetermined mass.

6. The actuator defined in claim 4 further comprising:

means for coupling said armature to said blocking member such that during an initial portion of the motion of said armature in said first direction said armature has no effect on said blocking member, and such that during a subsequent portion of the motion of said armature in said first direction said armature causes said blocking member to move from said blocking position to said release position.

7. The actuator defined in claim 1 wherein said first and second longitudinal axes are parallel to one another.

8. The actuator defined in claim 1 further comprising:

means for optionally allowing said means for releasably retaining to be manually operated to release said actuator member.

9. The actuator defined in claim 1 wherein said armature is symmetrical about said second longitudinal axis.

10. The actuator defined in claim 1 wherein said means for releasably retaining and said means for operatively connecting are symmetrical about said first longitudinal axis.

11. A linear electromechanical actuator comprising:

a housing having a longitudinal axis;

an electromagnet disposed in said housing;

an armature electromagnetically coupled to said electromagnet and mounted in said housing for longitudinal motion relative to said housing in a first direction along said longitudinal axis in response to energization of said electromagnet;

a first spring for resiliently urging said armature to move in a second direction along said longitudinal axis, said second direction being opposite to said first direction, said electromagnet being strong enough when energized to overcome the effect of said first springs on said armature and cause said armature to move in said first direction;

an actuator member partly disposed in said housing and mounted for longitudinal reciprocation relative to said housing along said longitudinal axis;

a second spring for resiliently urging said actuator member to move in said second direction along said longitudinal axis from a first position to a second position, said actuator member extending farther from said housing in said second position than in said first position;

a plurality of circumferentially spaced tines extending from said actuator member substantially parallel to said longitudinal axis, each of said tines having a latching surface which is transverse to said longitudinal axis and which projects from the associated tine in the direction away from the other tine or tines for releasably engaging a surface of said housing to hold said actuator member in said first position when said latching surfaces thus engage said housing surface;

a longitudinal member mounted in said housing for longitudinal reciprocation relative to said housing along said longitudinal axis, a first end portion of said longitudinal member being interposable between said tines to maintain said latching surfaces in engagement with said housing surface, said longitudinal member being in an intermediate position along said longitudinal axis when said longitudinal member is thus interposed between said tines, said intermediate position being intermediate a firing position and a released position;

a third spring for resiliently urging said longitudinal member to move in said second direction along said longitudinal axis from said firing position to said released position;

means disposed on said longitudinal member for preventing said longitudinal member from moving from said intermediate position to said released position when said first end portion of said longitudinal member is interposed between said tines; and means for coupling said longitudinal member to said armature so that movement of said armature in said first direction causes said longitudinal member to move from said intermediate position to said firing position, thereby withdrawing said first end portion of said longitudinal member from between said tines, allowing said tines to deflect toward one another, and disengaging said latching surfaces from said housing surface so that said second spring can cause said actuator member to move from said first position to said second position.

12. The actuator defined in claim 11 wherein said coupling means causes said longitudinal member to move only during a final portion of the movement of said armature in said first direction.

13. The actuator defined in claim 11 wherein, when said electromagnet is deenergized after said energization, said first spring causes said armature to move back in said second direction, and said third spring causes said longitudinal member to move from said firing position to said released position.

14. The actuator defined in claim 13 wherein, after movement of said actuator member to said second position, said actuator member can be moved back to said first position, and wherein said actuator further comprises:

means responsive to movement of said actuator member back to said first position for moving said longitudinal member from said released position through said intermediate position to a transitional position, after which said third spring causes said longitudinal member to move from said transitional position to said intermediate position, thereby re-interposing said first end portion of said longitudinal member between said tines and re-engaging said latching surfaces with said housing surface.

15. The actuator defined in claim 14 further comprising:

means for detecting the position of said longitudinal member and for producing a first output indicative of the detected position.

16. The actuator defined in claim 15 wherein said means for detecting the position of said longitudinal member comprises:

means for producing a first output when said longitudinal member is in said intermediate position, and for producing a second output different from said first output when said longitudinal member is either in said released position or said transitional position.

17. The actuator defined in claim 11 further comprising:

means for allowing said longitudinal member to be manually moved from said intermediate position to said firing position.

18. The actuator defined in claim 11 wherein said tines are disposed symmetrically about said longitudinal axis.

* * * * *